US006514309B2

(12) United States Patent
LeBeau et al.

(10) Patent No.: US 6,514,309 B2
(45) Date of Patent: Feb. 4, 2003

(54) ACTIVATED FEEDSTOCK

(75) Inventors: Stephen E. LeBeau, Northville, MI (US); D. Matthew Walukas, Ypsilanti, MI (US); Raymond F. Decker, Ann Arbor, MI (US)

(73) Assignee: Thixomat, Inc., Ann Arbor, MI (US)

( * ) Notice: Subject to any disclaimer, the term of this patent is extended or adjusted under 35 U.S.C. 154(b) by 0 days.

(21) Appl. No.: 09/932,720

(22) Filed: Aug. 17, 2001

(65) Prior Publication Data

US 2002/0017165 A1 Feb. 14, 2002

Related U.S. Application Data

(62) Division of application No. 09/347,871, filed on Jul. 6, 1999, now Pat. No. 6,299,665.

(51) Int. Cl.[7] ..... C22C 23/00

(52) U.S. Cl. ..... 75/255; 75/249; 148/420; 420/407; 420/408; 420/411

(58) Field of Search ..... 75/255, 249; 148/420; 420/407, 408, 411

(56) References Cited

U.S. PATENT DOCUMENTS

| | | | | |
|---|---|---|---|---|
| 4,540,546 A | * | 9/1985 | Giessen | 420/590 |
| 5,041,160 A | * | 8/1991 | Zuliani et al. | 420/402 |
| 5,143,564 A | * | 9/1992 | Gruzleski et al. | 148/420 |
| 5,167,920 A | | 12/1992 | Skibo et al. | 420/548 |
| 5,849,115 A | | 12/1998 | Shiina et al. | 148/549 |
| 6,299,665 B1 | | 10/2001 | Le Beau et al. | 75/255 |

FOREIGN PATENT DOCUMENTS

| | | | |
|---|---|---|---|
| EP | 0 773 302 A1 | 5/1997 | |
| FR | 1 592 041 | 12/1970 | |
| JP | 57-192201 | 11/1982 | 75/340 |

OTHER PUBLICATIONS

Bianary Alloy Phase Diagrams, T.B. Massalski, Editor in Chief, American Society for Metals, 1986, pp 129–130.
ASM Handbook, vol. 2, ASM International, 1990, p. 174.

* cited by examiner

*Primary Examiner*—George Wyszomierski
(74) *Attorney, Agent, or Firm*—Brinks Hofer Gilson & Lione

(57) ABSTRACT

An alloy feedstock for semi-solid metal injection molding. The alloy feedstock is an alloy material in particulate form and has a heterogeneous structure, a temperature range at 20% of the height of the peak of the main melting reaction greater than 40° C., and having a ratio of the height of the peak of the eutectic reaction to the height of the main melting reaction of less than 0.5.

9 Claims, 12 Drawing Sheets

ACTIVATED FEEDSTOCK

CROSS REFERENCE TO RELATED APPLICATION

This application is a divisional application of prior U.S. application Ser. No. 09/347,871, filed Jul. 6, 1999, now U.S. Pat. No. 6,299,665.

BACKGROUND OF THE INVENTION

1. Field of the Invention

The present invention relates to a feedstock particularly adapted for use in semi-solid metal injection molding. More specifically, the present invention relates to a feedstock that more easily forms its liquid phase. As such, the feedstock forms its liquid phase at lower temperatures, with lower thermal gradients, less plugging and with less thermal shock in the initial zones of the semi-solid metal injection molding machinery. This in turn allows for faster feed rates, flood feeding of the feedstock, longer barrel life, less down time, less energy usage, superior molded parts and lower operating costs.

2. Brief Description of the Prior Art

Generally semi-solid metal injection molding is the process whereby an alloy feedstock is heated, subjected to shearing and injected under high pressure into a mold cavity. Heating brings the feedstock into a state where both solid and liquid phases are present while the application of shearing forces prevents the formation of dendritic structures in the semi-solid alloy. In this state, the alloy may exhibit thixotropic properties. It is to such alloys that the present invention is applicable.

The feedstock may be received into the barrel of the semi-solid metal injection molding machinery in one of three forms: liquid, semi-solid or particulate solid. The former two forms require additional equipment and special handling precautions to prevent contamination of the alloy material and therefore increase costs. The latter form, while being more easily handled results in longer cycle times and significant thermal gradients in the first encountered portions of the barrel and more pronounces thermal shock to that portion of the barrel. A solid feedstock which does not result in the above conditions is therefore seen as desirable.

More specifically, semi-solid metal injection molding (SSMI) involves the feeding of alloy feedstock into the barrel of the semi-solid metal injection molding machinery. In the barrel, the alloy feedstock is heated and subjected to shear, often by a screw located therein. As a result of heating and shearing, the temperature of the alloy feedstock is raised above its solidus temperature to a temperature below its liquidus temperature. Within this temperature range, the feedstock is transitioned into semi-molten material having co-existing solid and liquid phases. In addition to aiding to heating, shearing further prevents the formation of dendritic structures in the alloy. In this thixotropic state, the semi-solid alloy material is injected, either through a reciprocation of the screw or transferred to a shot sleeve, into a mold cavity and solidified to form the desired part.

U.S. Pat. Nos. 4,694,881, 4,964,882, 5,040,589, issued to the Dow Chemical Company, describe methods for semi-solid metal injection molding and an apparatus for performing the above process. These patents are herein incorporated by reference.

In conventional preparation of particulate feedstock, an ingot or billet is initially formed from the alloy, cooled and then mechanically chipped to provide particulates of the appropriate size. Notably, after the initial formation of the ingot or billet, cooling is effectuated slowly thereon. Magnesium alloy such as AE42 and aluminum alloy such as A356 are available in the above form.

As mentioned above, in carrying out the semi-solid injection molding process, use of conventional alloy feedstock results in the initial portion of the barrel, into which the feedstock is first received, being subjected to highly cyclic thermal loads in order to initiate the conditioning of the feedstock (while the exterior of this portion of the barrel remains highly heated, the interior is significantly cooled upon the influx of each new change of feedstock). As a result of the high thermal gradient therein, this portion of the barrel experiences high thermal stresses.

The common characteristic of the above type of alloy feedstocks is that, upon review of a differential scanning calorimetry (DSC) curve, it is noted that the alloy feedstocks exhibit a sharp and vigorous absorption of energy during initial melting temperatures. This sharp energy requirement over a narrow temperature region places an abnormal heating demand on the barrel in a short region which therefore sees high temperature gradients (between the barrel's inner and outer surfaces) and high thermal stresses. Since as much as approximately fifty percent of the melting occurs within 30° C. of the solidus temperature of the low melting point constituent, if advancement of the material within the barrel is not precisely controlled, this pronounced sensitivity to a small temperature change can result in freezing of the material within the barrel as a plug forms around the screw. When such freezing and plug formation occurs, good parts can no longer be produced. It requires pulling the screw and the time consuming operation of cleaning the screw and barrel, at a significant cost and loss of production. If freezing and plug formation do not occur, the necessary time for heating the material to the appropriate molding temperatures limits feed rates and cycle times for the machinery.

In view of the above and other limitations, it is an object of the present invention to provide a particulate feedstock that forms its liquid phase more easily allowing for faster feed rates and decreased cycle times for the semi-solid injection molding machinery. Additionally, an object of the present invention is to provide a feedstock that allows for lower barrel temperatures, decreased thermal gradients through the barrel wall, and less thermal shock on the barrel. A further object of the present invention is to provide a feedstock which will allow for the presence of a small percentage (five to twenty percent) of the alloy's initial liquid phase in the first heating zone of the machine thereby improving heat transfer to the remaining constituents of the alloy in the subsequent heating zones of the barrel. Another object of this invention is an alloy feedstock whose DSC curve generally follows the temperature profile of the barrel over the barrel's length, thereby reducing thermal gradients and shock in the barrel. One feature of the present invention is therefore the ability to mold alloys that have a higher solidus temperature than alloys conventionally used in semi-solid molding.

SUMMARY OF THE INVENTION

In overcoming the above and other limitations of prior art feedstock, the present invention provides for an activated particulate feedstock which more easily forms a portion of its liquid phase in the initial zones of the barrel of the semi-solid metal injection molding machine. Alloy feedstock according to the present invention is provided in a particulate form and includes a heterogeneous structure, has a temperature range at 20% of the height ($H_L$) of the peak of the main melting reaction ($\Delta T_{20\%}$) greater that 40° C., and has a ratio ($R_{E/L}$) of the height of the peak of the eutectic reaction ($H_E$) to the height of the peak of the main melting reaction ($H_L$) of less than 0.5. Alloy feedstock according to the present invention may also have a melting range from solidus to liquidus temperature ($\Delta T_{S-L}$) of greater than 140° C., 80° C. for Zn. By providing an alloy feedstock according to the above, upon entering the initial zone of the barrel, some of the low melting temperature constituent melts quickly and as a result, "activates" further melting of the feedstock. Hence the title of the present invention "Activated Feedstock." In activating further melting, the early presence of the liquid phase of the lower melting temperature constituent enhances thermal conductivity to the un-melted portion of the feedstock, increasing the melt rate.

By more quickly initiating melting in the initial portions of the barrel, less thermal shock and lower thermal stresses are applied to the barrel as a result of the thermal gradient through the barrel wall. Because of the improved heat transfer, faster feed rates including flood feeding can be utilized with the machine. It also allows for lower barrel temperatures and obviates plug formation about the screw. Also, alloys that would typically have had too high of a solidus temperature for semi-solid metal injection molding, can now be molded in a semi-solid metal injection molding machine.

These and other objects and features of the present invention will be more readily appreciated by one skilled in this technology from the following description and claims, in conjunction with the drawings.

DETAILED DESCRIPTION OF THE PREFERRED EMBODIMENT

Figure 1:
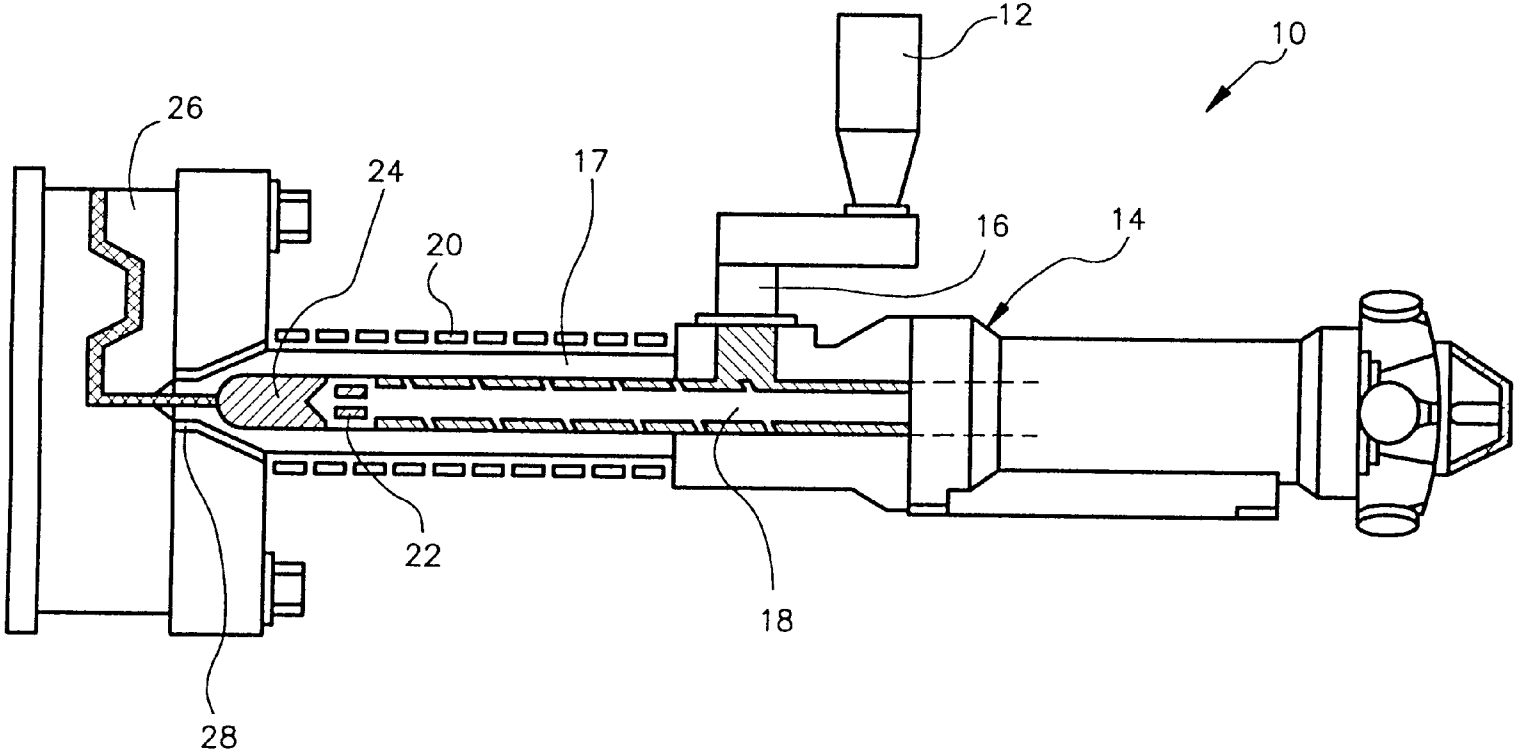
FIG. 1 is a schematic illustration of one version of a semi-solid metal injection molding machine with which the present invention may be utilized.

Referring now to the drawings, seen in FIG. 1 is an apparatus/machine 10 used for semi-solid metal injection (SSMI) molding. The construction of the machine 10 is, in some respects, similar to that of a plastic injection molding machine.

In the illustrated machine 10, feedstock is fed by a hopper 12 into a heated barrel 17 of a reciprocating screw injection system 14. The system 14 maintains the feedstock under a protective atmosphere 16, such as argon or another non-reactive gas. As the feedstock is moved forward by the rotating motion of a screw 18, it is heated by heaters 20 and stirred and sheared by the action of the screw 18. This heating and shearing is done to bring the feedstock material into a state where both solid and liquid phases co-exist, thereby forming a thixotropic slurry. The material then passes through a non-return valve 22 in the forward end of the injection system 14 and into an accumulation chamber 24. Upon accumulation of the needed amount of material in the chamber 24, the injection cycle is initiated by advancing the screw 18 with a hydraulic actuator (not shown) causing the material to fill through a nozzle 28 into a mold 26.

As opposed to other methods of semi-solid molding, the above described method has the advantage of combining slurry generation and mold filling into a single step. It also minimizes safety hazards which occur when separately melting and casting reactive semi-solid metal alloys. Obviously, and as will be further appreciated, the alloy feedstock of the present invention will have utility with machines other than the one of the illustrated variety. By way of illustration and not of limitation, such other variety machines and apparatus include two stage machines and plastic injection molding machines, similar to die casting machines, where slurry generation and injection molding occur in separate portions of the apparatus, and non-horizontally oriented machines.

Figure 11:
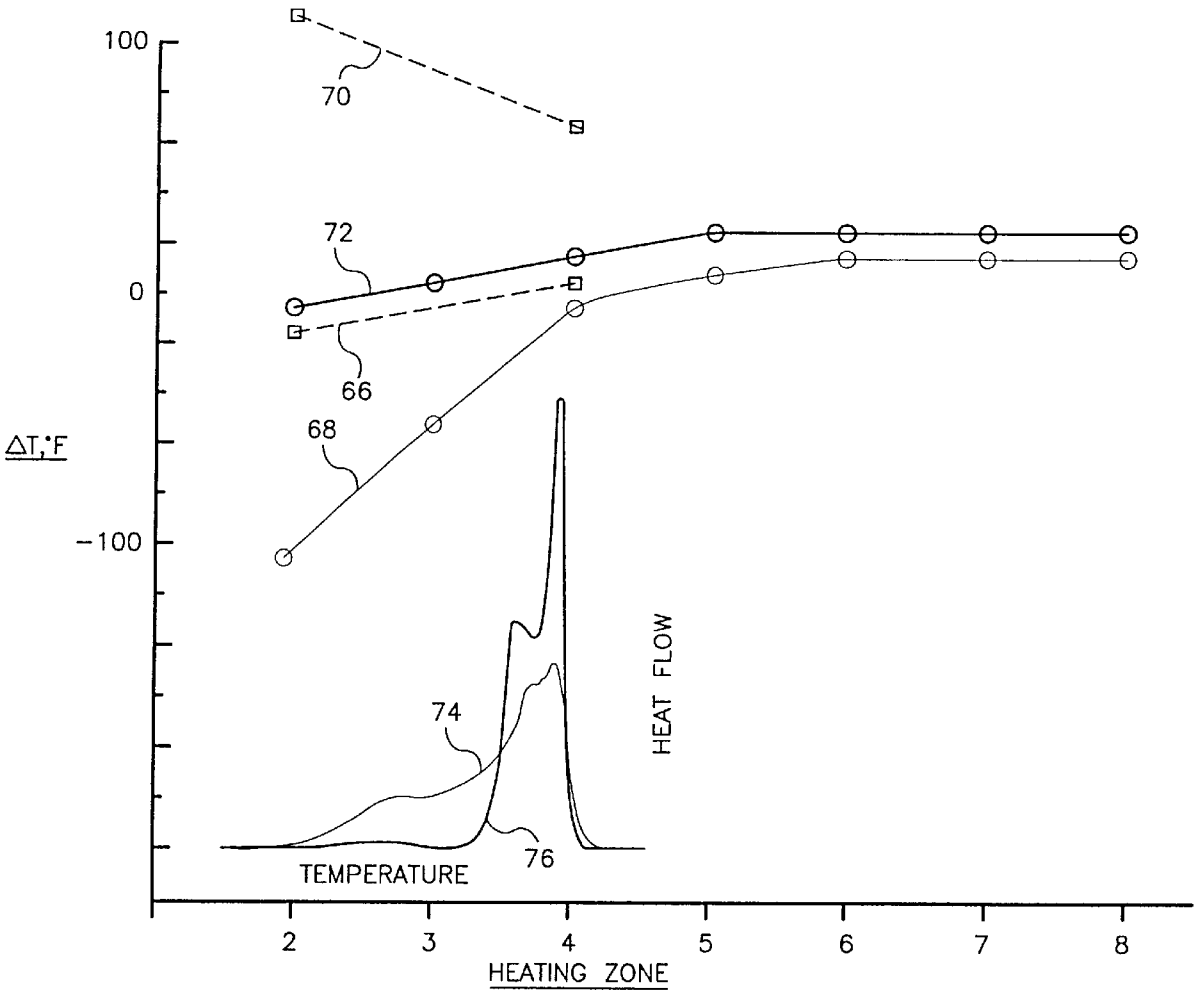
FIG. 11 is a plot of the change in the barrel temperature across the various heating zones of the barrel, including DSC curves for the heterogeneous alloys of FIGS. 4 and 6 relative to the position of the material in the barrel.

The barrel 17 of the machine 10 is divided along its length into a series of different heating zones. While a greater or lesser number of zones may be used (including additional zones in the nozzle 28 area of the machine 10), nine zones are discussed herein for illustrative purposes. Proceeding from the end of the barrel 17 where the feedstock is received, the respective heating zones are increasingly hotter until leveling out in the latter half of the barrel 17. While the actual number of heating zones and their respective temperatures will vary depending on the particular alloy being molded, the characteristics of the desired part and the specifics of the machine 10 itself, FIG. 11 illustrates along its bottom axis eight heating zones and their respective temperatures. These zones and temperatures are as follows: zone one—427° C.; zone two—538° C.; zone three—566° C.; zone four—594° C.; zone 5—605° C. and zones six through nine—605° C. The above temperatures are barrel temperatures measured by a thermocouple positioned approximately three-quarters of the way through the barrel (towards the interior of the barrel), the barrel being constructed of alloy 718 and having a wall thickness of about 3.7 inches. The temperatures are representative for molding AZ91 and AE42 alloys from particulate feedstock.

As such, the present inventors sought to design a feedstock with a gradual melting reaction to match the temperature profile along the barrel 17. In this manner, processing of the feedstock material is done while imparting vigorous shear to the semi-solid, avoiding plugs, preventing thermal shock and cracking of the barrel and while being able to precisely fix the fraction solids in the subsequently molded part.

As mentioned above, one of the objects of the present inventors was to develop an alloy feedstock which would enable faster cycle times while decreasing thermal shock and stress on the machine 10. In so doing, the inventors hypothesized that the resulting alloys would need to exhibit a mild on-setting of melting or a spreading of the eutectic reaction over a larger temperature range, when initially introduced into the barrel. By easing the on-set of melting and spreading out the eutectic reaction, thermal shock in the initial portion of the barrel would be decreased. Upon the on-set of melting and the introduction of the liquid phase in the feedstock, thermal transfer would be enhanced and further melting would be activated.

A particulate feedstock currently used in SSMI is the magnesium alloy known as AZ91. Commonly available AZ91 feedstock is developed by first forming the alloy into an ingot and then mechanically chipping the ingot to produce the alloy in its particulate form.

Figure 2:
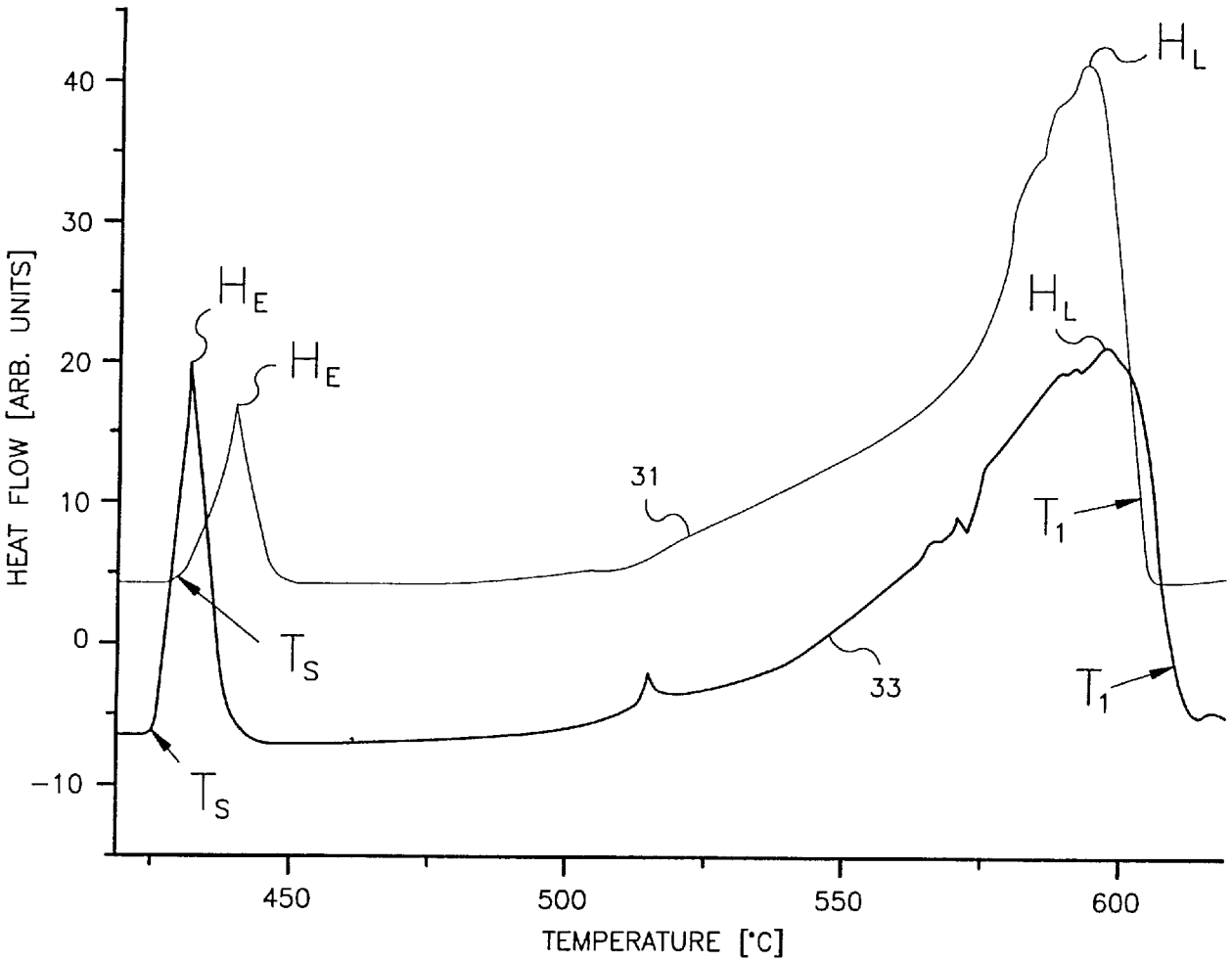
FIG. 2 is a DSC curve, heat flow versus temperature, for AZ91D alloy having a moderately heterogeneous structure and the same alloy having a homogeneous structure. Heating rate is 20° K/minute in this case and the DSC curves to follow as is the sample weight of 12–15 mg.

As mentioned above, the DSC curves for an AZ91 alloy are seen in FIG. 2. It is noted that the DSC curves seen in FIG. 2, and in the figures which follow, have been shifted relative to one another for the sake of clarity.

The particulate feedstock utilized to generate a first trace 31 in FIG. 2 was formed by mechanically chipping an AZ91 alloy ingot. Being formed from ingot stock, the microstructure of the feedstock was moderately heterogeneous and resulted from slow cooling of the ingot at about 3° C./s. The particulate feedstock formed from AZ91 alloy ingot exhibits a DSC curve with a sharp and vigorous absorption of energy at its eutectic reaction beginning immediately after $T_S$ (433° C.), $T_s$ being the first on-set of melting. From the diagram and the initial spike at $T_S$, it is seen that a significant amount of heat must flow into the feedstock over a short temperature range, up to about 450° C., to initiate melting. As a result, the barrel 17 is subjected to a significant thermal shock upon the initial introduction of this feedstock.

In this trace, $H_L$ represents the main melting peak and $T_L$ generally represents the attainment of the liquidus temperature of the alloy at approximately 602° C. The change in temperature ($\Delta T_{S-L}$) from the solidus temperature $T_S$ to the liquidus temperature $T_L$ is 169° C.

From this first trace 31, it is seen that the ratio ($R_{E/L}$) of the peak of the eutectic reaction ($H_E$) to the peak of the main melting spike ($H_L$) is about 0.3. By measuring the width of the main melting peak at 20% of its height, a temperature range ($\Delta T_{20\%}$) can be established between the positive and negative sloped sides of the main melting peak. For the first trace 31 in FIG. 2, $\Delta T_{20\%}$ is about 55° C.

To determine the effects of a different thermal history on the feedstock, the particulate alloy of the first trace 31 was heated until completely melted and was then subsequently slow cooled at a rate of about 0.6° C./s, resulting in a near equilibrium homogeneous microstructure. As seen from its DSC curve, the second trace 33 in FIG. 2, a sharper and even more vigorous reaction than in the first trace 31 occurs in the eutectic reaction beginning at $T_S$. The particulate feedstock of the second trace 33 therefore undergoes a more vigorous absorption of energy over a narrower temperature and the ratio $R_{E/L}$ of the height $H_E$ of the eutectic reaction to the height ($H_L$) of the main melting reaction is 0.8. Its liquidus temperature is reached at approximately 610° C. From this, the range of melting $\Delta T_{S-L}$ is approximately 181° C.

With the less intense initial reaction as seen by the first trace 31, more distance in the barrel 17 is utilized by the first feedstock to impart the melting energy for the moderately heterogeneous AZ91 alloy feedstock of the first trace 31 than for the near equilibrium homogeneous AZ91 alloy forming the second trace 33. As a result, relative to the material of the second trace 33, thermal shock in the initial and subsequent zones of the barrel 17 are more diminished and a longer "feed zone" can be maintained to enforce mechanical advancement of the feedstock while the feedstock is still relatively solid. If the melting zone is too short, the feedstock immediately adjacent to the screw 18 is susceptible to refreezing as additional, cooler feedstock is introduced into the barrel 17. Notably, the screw 18 is already cooler than the barrel 17 and this further promotes refreezing. This refrozen feedstock results in the formation of a plug, within the barrel 17 about the screw 18, which prevents forwarding by the screw 18 of any additional feedstock. Once plugged, the machine 10 must be stopped, cooled, the barrel 17 and screw 18 taken apart and cleaned before being put back together, preheated and put back into service. In worst case scenarios, the barrel or screw may have to be replaced.

Figure 3:
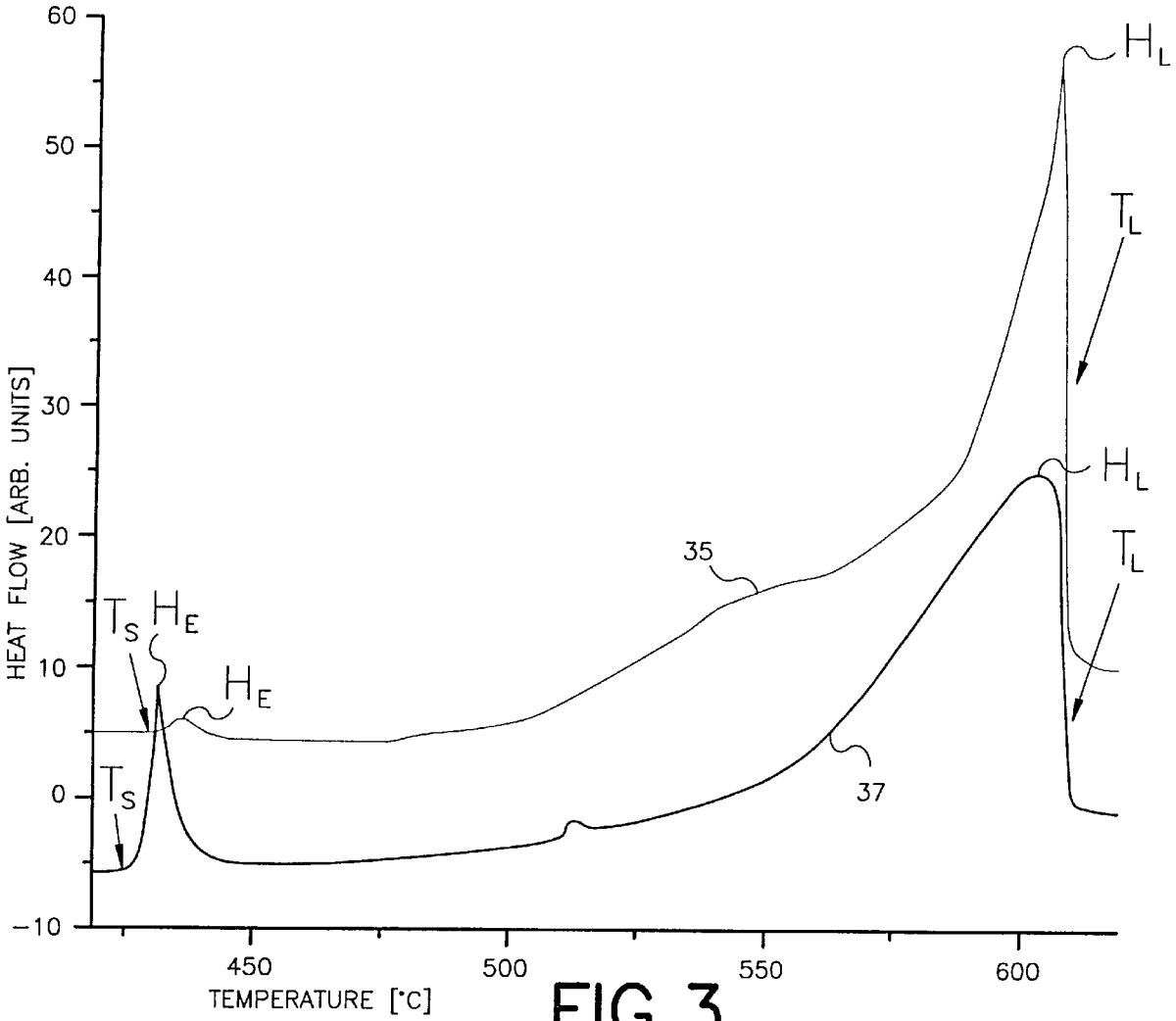
FIG. 3 is a DSC curve for AZ91D alloy formed from a recycled die casting scrap in both heterogeneous form and homogeneous forms.

Referring now to FIG. 3, a second sample of AZ91 alloy, having a different thermal history and structure (formed from relatively fast cooled die casting scrap, cooling estimated at about 20° C./s), having a microstructure which is more heterogeneous than the AZ91 feedstock which resulted in the first trace 31 of FIG. 2, has its DSC curve plotted as first trace 35.

First trace 35 illustrates a broad reaction believed to begin before the eutectic temperature represented by $T_S$, less than 431° C., with this reaction being very moderate and broadened in temperature as evidenced by the small spike associated therewith. The liquidus temperature $T_L$ is achieved at approximately 609° C. The melting range for the alloy $\Delta T_{S-L}$ is therefore calculated at greater than 178° C. The ratio ($R_{E/L}$) the peak of the eutectic reaction ($H_E$) to the peak of the main melting reaction ($H_L$) for this first trace 35 is 0.2. The temperature range ($\Delta T_{20\%}$), is about 71° C.

As with the first example to determine the effect of the different thermal history upon the particulate feedstock following the first trace 35 in FIG. 3, the AZ91 alloy (die cast scrap) was heated to complete melting, slow cooled to form a near equilibrium homogeneous microstructure and its DSC curve plotted. As seen in the second trace 37 of FIG. 3, a more vigorous eutectic reaction occurs as evidenced by the sharp peak beginning at $T_S$. $T_S$ is seen to be at about 430° C. and $T_L$ being reached at 612° C. $\Delta T_{S-L}$ is therefore 182° C. $\Delta T_{20\%}$ for this second trace 37 is seen to be about 66° C. and $R_{E/L}$ is seen to be about 0.5.

Figure 4:
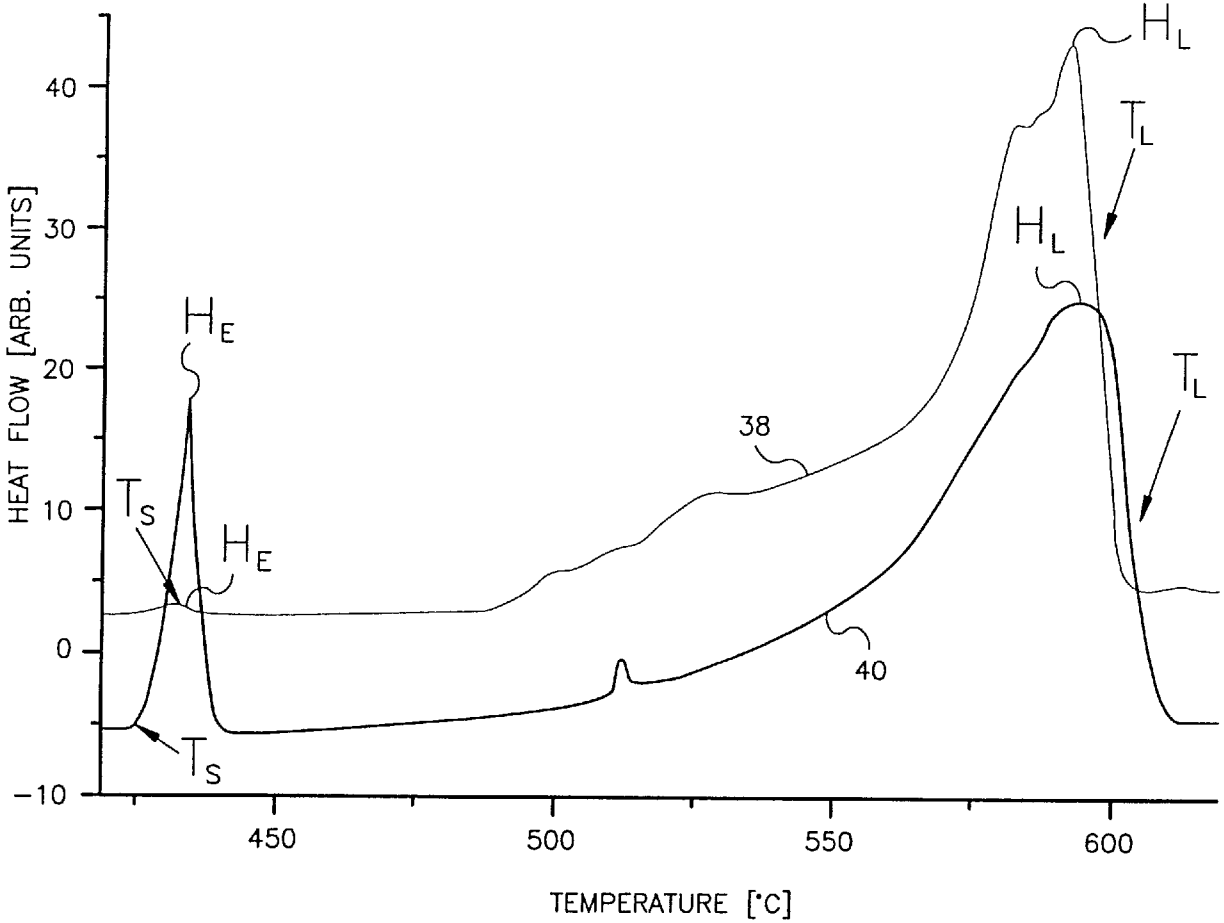
FIG. 4 is a DSC for AZ91D alloy formed from semi-solid injection molding scrap in both heterogeneous and homogeneous forms.

A third sample of AZ91 alloy with yet another thermal history has its DSC curve plotted in FIG. 4. This particulate feedstock was formed from thin scrap from SSMI molded parts. Accordingly, the microstructure of the particulate feedstock of this third example was the most heterogeneous sample formed from AZ91 alloy because of the high cooling rate for such scrap, approximately 40° C./s. The melting range ($\Delta T_{S-L}$) from the solidus temperature $T_S$ (which is less than 439° C.) to the liquidus temperature $T_L$ (601° C.) is therefore calculated to be greater than about 162° C.

As seen in the first trace 38 of FIG. 4, a broad eutectic reaction occurs for this particulate feedstock believed to begin before the small peak beginning at $T_S$. The ratio ($R_{E/L}$) of the peak of the eutectic reaction ($H_E$) to the peak of the main melting reaction ($H_L$) is about 0.01 and the temperature range ($\Delta T_{20\%}$), is 66° C.

As with the prior two examples, this particular feedstock utilized to produce the first trace 38 in FIG. 4 was heated to complete melting and slowly cooled to form a near equilibrium homogeneous microstructure. This remelt of the alloy has its DSC curve plotted as the second trace 40 of FIG. 4. When compared to the first trace 38, immediately after the solidus temperature $T_S$, very significant and vigorous absorption of energy begins as the material undergoes its eutectic reaction. The thermal duration for this reaction is quite narrow (only about 13° C.) as evidenced by the sharp peak beginning at $T_S$, about 425° C. The liquidus temperature $T_L$ is reached at 607° C. The temperature range for melting ($\Delta T_{S-L}$) can thus be calculated at 182° C. From this trace 40, the ratio ($R_{E/L}$) of the peak of the eutectic reaction ($H_E$) to the peak of the main melting reaction ($H_L$) is about 0.8 while the temperature range ($\Delta T_{20\%}$), is about 66° C.

The broadening of the eutectic reaction and the start of the reaction at lower temperatures than $T_S$ is exhibited in traces 35 and 38. This is due to the fast cooling rate of these feedstocks and the resultant heterogeneity. This lowering of start temperatures for melting by fast cooling rates is confirmed by the following data on AZ91D in Table 1.

TABLE 1

| Cooling Rate, ° C./S | 0.03 | 0.06 | 0.04 | 21 | 41 |
|---|---|---|---|---|---|
| Solidus, ° C. | 435 | 435 | 430 | <328 | <328 |

Fast cooling, such as in shot, does not allow homogenization of the microstructure, leaving segregates high in alloying elements. The segregated volumes are subject to super cooling below the eutectic temperature before solidification. In turn on heating, these volumes tend to melt below the equilibrium eutectic temperature.

Figure 12:
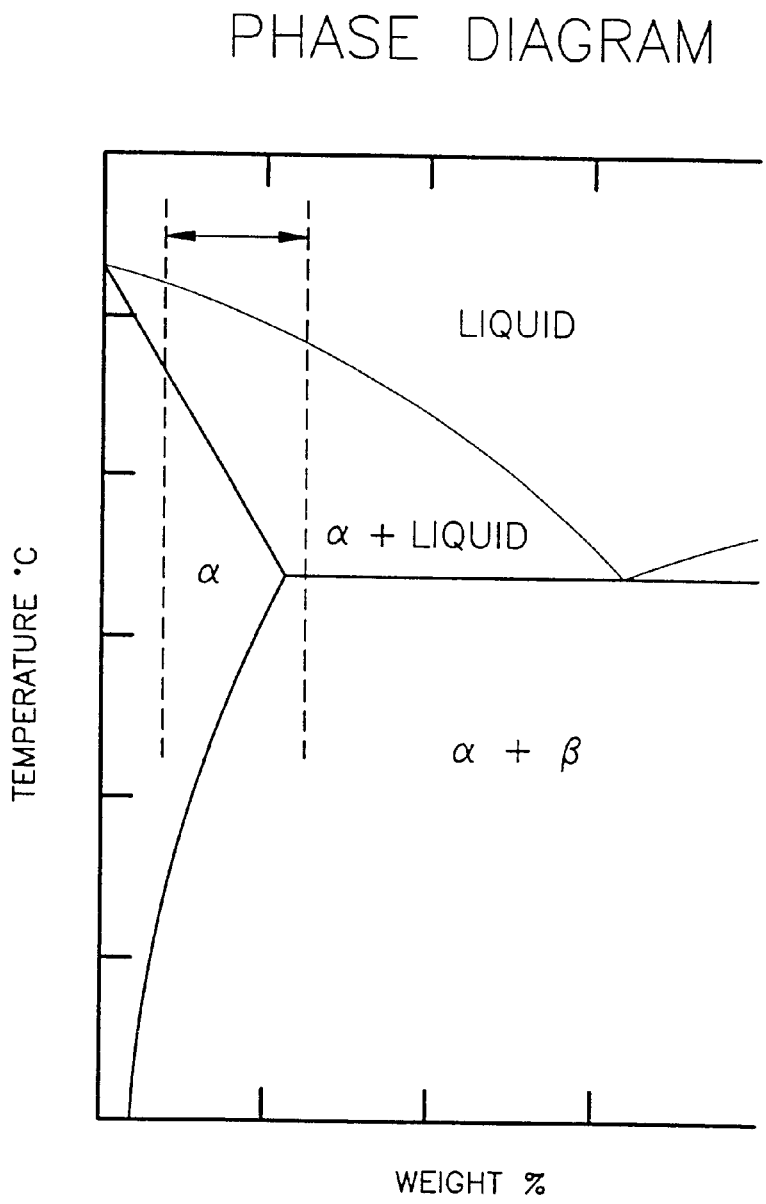
FIG. 12 is a general phase diagram illustrating a preferred range for alloys according to the present invention for use in semi-solid metal injection molding processes.

Pre-segregation can be created before shotting by holding the melt in the two-phase $\alpha+\beta$ region of FIG. 12. The liquid becomes further elevated in alloying elements, which further exaggerates the super cooling effect. This further lowers the final freezing temperature and initial melting temperature of this special form of shot.

The temperature range ($\Delta T_{20\%}$) for the main melting peak, $H_L$, is also of great interest. It is measured by the width of this peak at 20% of its height, $H_L$. Too narrow of a range would exacerbate the thermal shock and plugging problems mentioned above. A narrow range would require a higher outside barrel temperature in the first zones of the barrel 17 resulting in more thermal shock to those zones. With a broader range, the DSC curve will more closely follow to temperature curve of the barrel 17 itself through its various zones.

This is illustrated by another magnesium sample utilizing particulate feedstock resulting from the mechanical chipping of an ingot of AM50 alloy. Being chipped from an ingot, the AM50 alloy exhibits a microstructure which is only moderately heterogeneous. As seen in the first trace 42 of FIG. 5, the DSC curve of this particular feedstock illustrates a solidus temperature of about 520° C. with a spread out initial eutectic reaction with no defined peak. The liquidus temperature ($T_L$) for the AM50 alloy particulate feedstock is seen at about 631° C. and the range of melting ($\Delta T_{S-L}$) is therefore only about 111° C.

With no defined initial peak in the first trace 42, the ratio of the peak of the eutectic reaction ($H_E$) to the peak of the main melting reaction ($H_L$) is negligible or 0.$\Delta T_{20\%}$ can be seen to be about 34° C. This alloy is more difficult to mold than AZ91D, FIG. 4, because of the low $\Delta T_{20\%}$.

Figure 5:
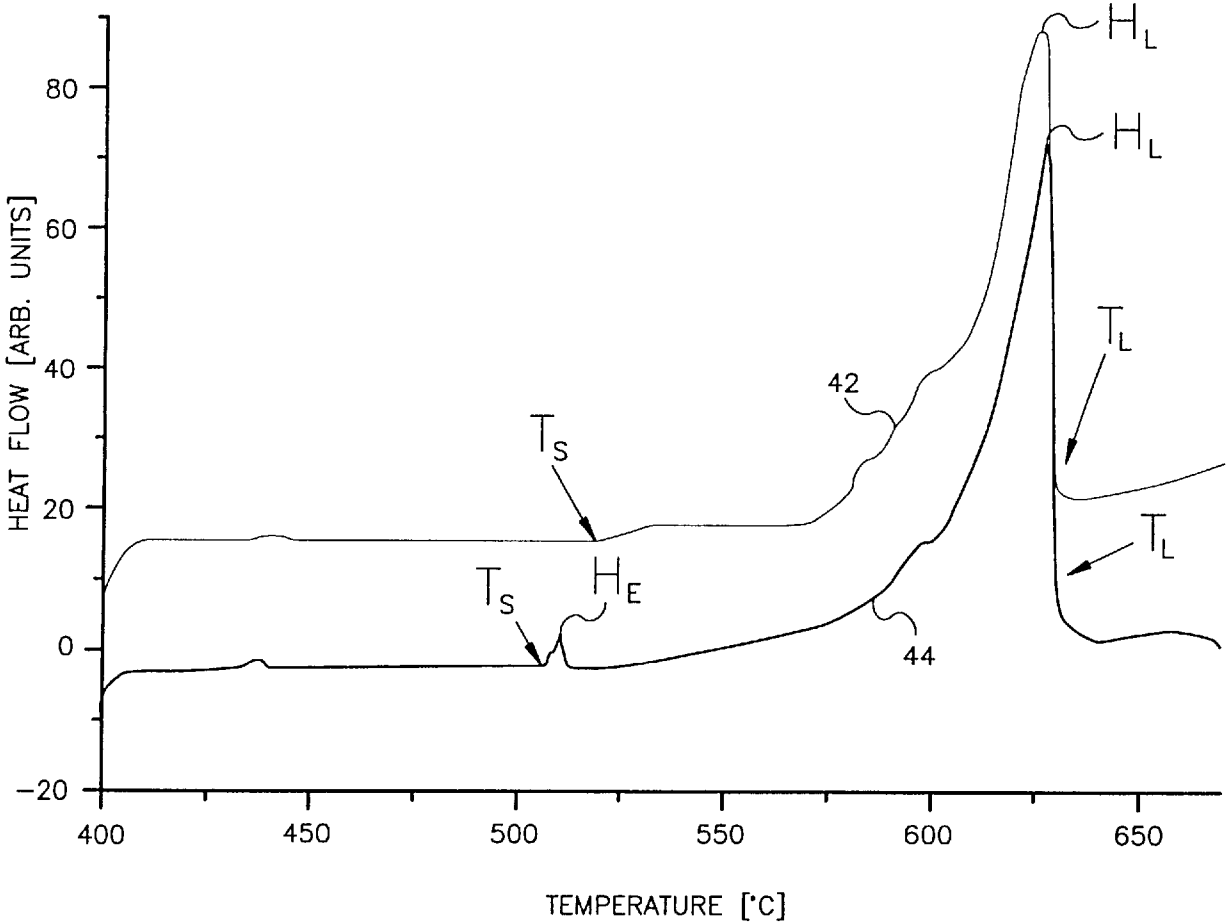
FIG. 5 is a DSC curve for AM50 alloy in both heterogeneous and homogeneous forms.

A second trace 44 of AM50 alloy, after the alloy of the first trace has been heated to complete melting and subsequently slow cooled to result in a near equilibrium homogeneous microstructure, is also seen in FIG. 5. This homogeneous feedstock exhibited a solidus temperature ($T_S$) of about 507° C., a liquidus temperature ($T_L$) of about 632° C. and a range from solidus to liquidus ($\Delta T_{S-L}$) of about 125° C. $\Delta T_{20\%}$ is seen to be about 32° C. and the ratio $R_{E/L}$ is seen to be about 0.05.

Figure 6:
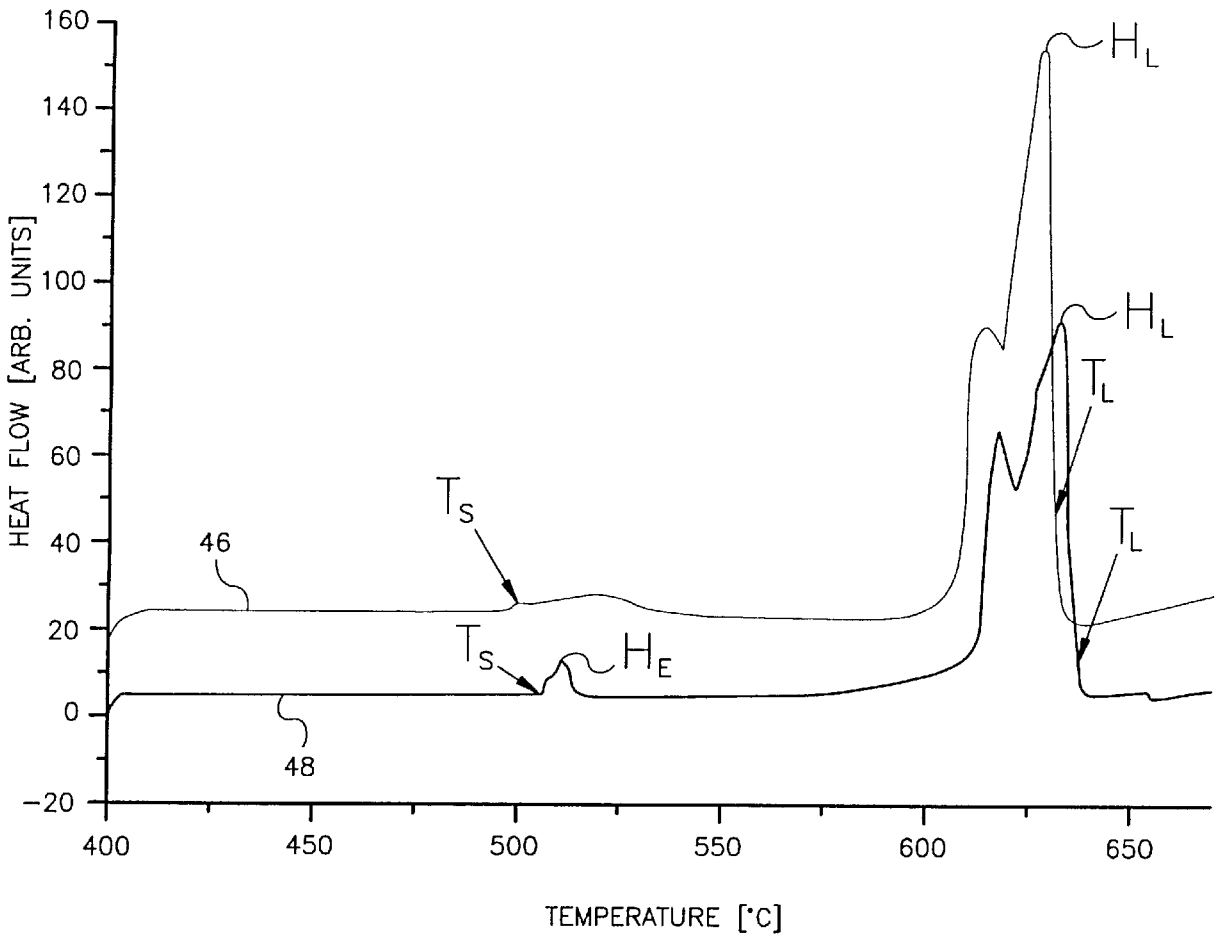
FIG. 6 is a DSC curve for AE42 alloy in both heterogeneous and homogeneous forms.

Particulate feedstock of AE 42 alloy, chipped from a moderately cooled ingot and therefore having a moderately heterogeneous microstructure, has its DSC curve illustrated as the first trace 46 in FIG. 6. The first trace 46 of this fifth sample exhibits some characteristics similar to the first trace 42 of AM50 alloy in that a spread out initial reaction with no defined peak begins at $T_S$, being about 500° C. While initial reaction is moderate with no spiking, this trace exhibits a narrow main melting peak $H_L$ and a liquidus temperature $T_L$ reached shortly thereafter at 633° C. The resulting range of heating from solidus to liquidus ($\Delta T_{S-L}$) is therefore about 133° C. With no marked spike in the initial reaction, $R_{E/L}$ is negligible or 0. The temperature range at $\Delta T_{20\%}$ is seen to be narrow, 20° C., because of the sharpness of the main melting peak.

Heating the AE42 alloy to complete melting and then subjecting it to slow cooling to form a near equilibrium homogeneous microstructure and subsequently developing a DSC curve for this material results in the second trace 48, seen in FIG. 6. Compared to the first trace 46, $T_S$ has shifted to a higher temperature of about 508° C. and evidences a sharper spike for the initial or eutectic reaction. The liquidus temperature ($T_L$) has shifted moderately to about 638° C. As a result, the range of temperature from solidus to liquidus ($\Delta T_{S-L}$) actually decreases relative to the first trace 46 to 130° C.

Figure 7:
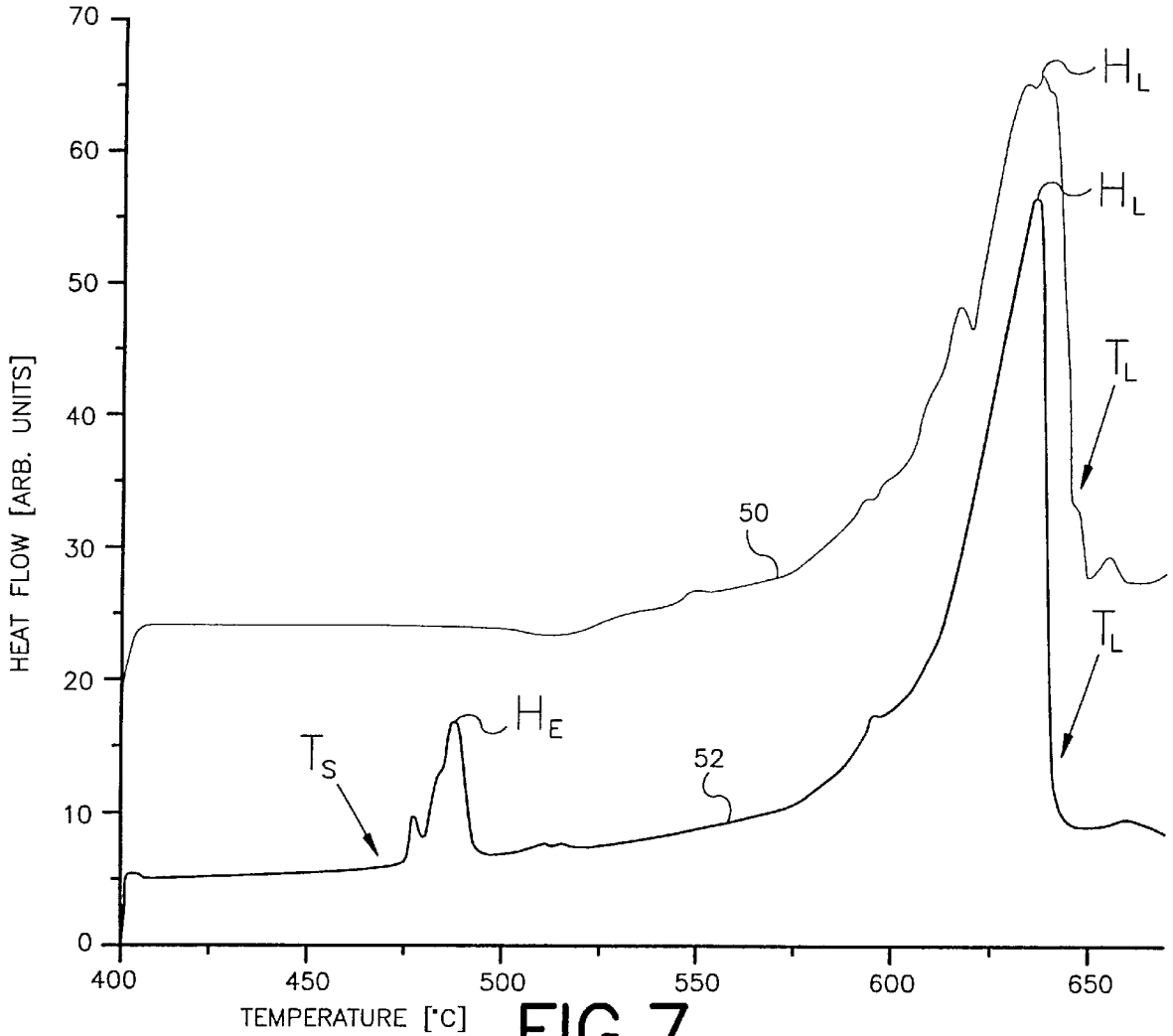
FIG. 7 is a DSC curve for ZK60 alloy both heterogeneous and homogeneous forms.

FIG. 7 illustrates the DSC curve for a sixth sample, ZK60 alloy, mechanically chipped from the ingot stock. Being chipped from an ingot, the ZK60 alloy exhibits a microstructure which is only moderately homogeneous or mildly heterogeneous. As seen in the first trace 50 of FIG. 7, no initial peak is illustrated until the main melting peak $H_L$. A liquidus temperature ($T_L$) is seen to be about 648° C. and therefore the temperature range from solidus to liquidus ($\Delta T_{S-L}$) is anticipated to be about or greater than 163° C. (based upon the second trace 52 for the remelt of ZK60 alloy as further discussed below). Without any evidence of an initial reaction peak, the ratio of the peak of the eutectic reaction to the peak of the main melting reaction is negligible or 0. From the main melting peak, the temperature range ($\Delta T_{20\%}$), is seen to be 49° C.

The second trace 52 seen in FIG. 7 is for the near equilibrium homogeneous microstructure achieved after complete heating and subsequent slow cooling. In the second trace 52 of FIG. 7, $T_S$ is at about 475° C. A relatively sharp eutectic reaction follows, peaking at about 485° C. From this second trace 52, it is seen that the liquidus temperature is reached at about 638° C. with a temperature range ($\Delta T_{S-L}$) from solidus to liquidus being about 163° C. Comparing the main melting peak to the eutectic reaction peak, the ratio of these peaks is seen to be about 0.21. The temperature range ($\Delta T_{20\%}$), is about 40° C.

Figure 8:
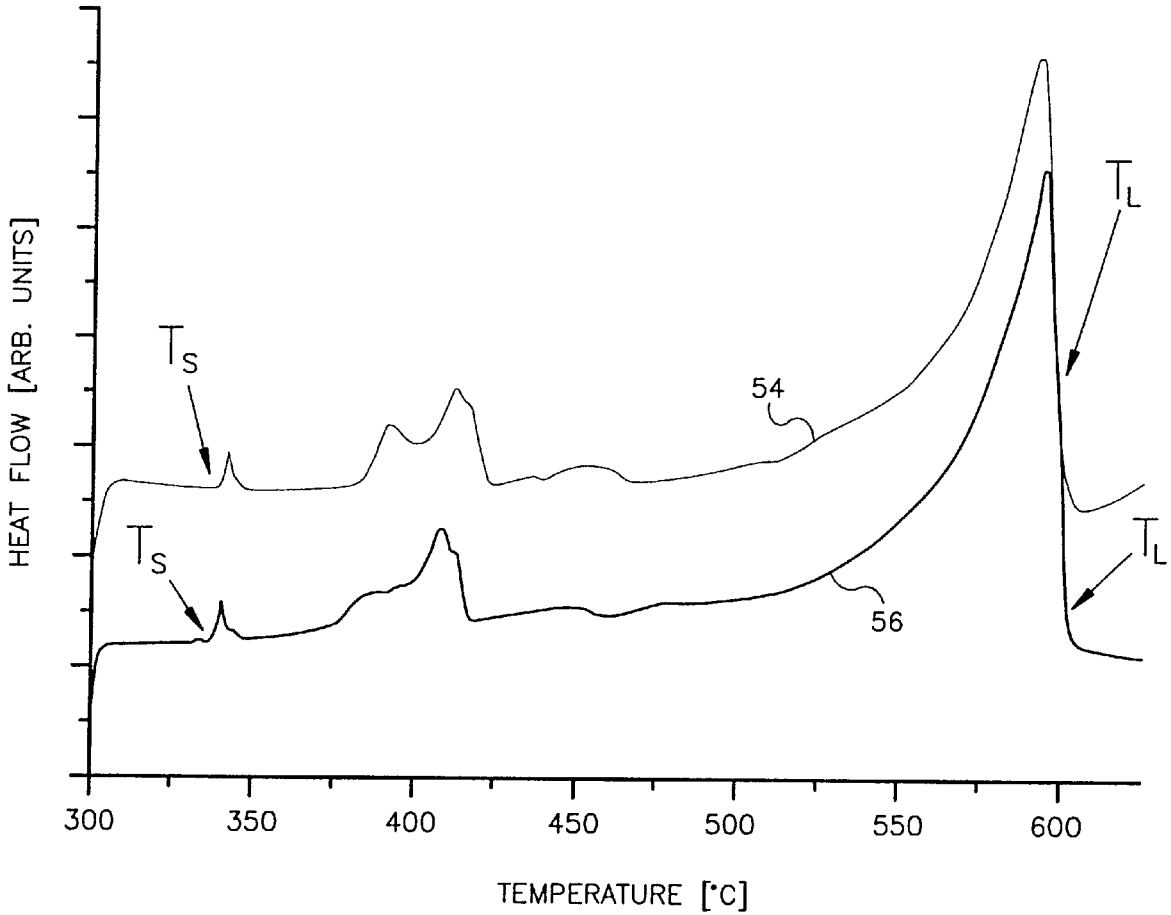
FIG. 8 is a DSC curve for ZAC magnesium alloy in both heterogeneous and homogeneous forms.

Referring now to FIG. 8, the first trace 54 is the DSC curve for ZAC alloy formed from ingot stock. The solidus temperature for the onset of initial melting is about 337° C. and the liquidus temperature $T_L$ seen to be about 601° C. From this, the temperature range ($\Delta T_{S-L}$) from solidus to liquidus is calculated at 264° C. The ratio ($R_{E/L}$) of the peak of the eutectic reaction to the peak of the main melting reaction is about 0.14 while the temperature range ($\Delta T_{20\%}$), is about 59° C.

The second trace 56 seen in FIG. 8 is for the near equilibrium homogeneous structure ZAC alloy formed after heating the initial alloy to complete melting and slow cooling the alloy. In this second trace 56, $T_S$ occurs at about 340° C., $\Delta T_L$ at about 603° C. and $\Delta T_{S-L}$ is about 263° C. $R_{E/L}$ can be seen to be about 0.13, while $\Delta T_{20\%}$ is seen to be about 63° C.

While the above discussed alloys are magnesium alloys, two aluminum alloys were also investigated. Those aluminum alloys include A356 alloy and 520 alloy.

Figure 9:
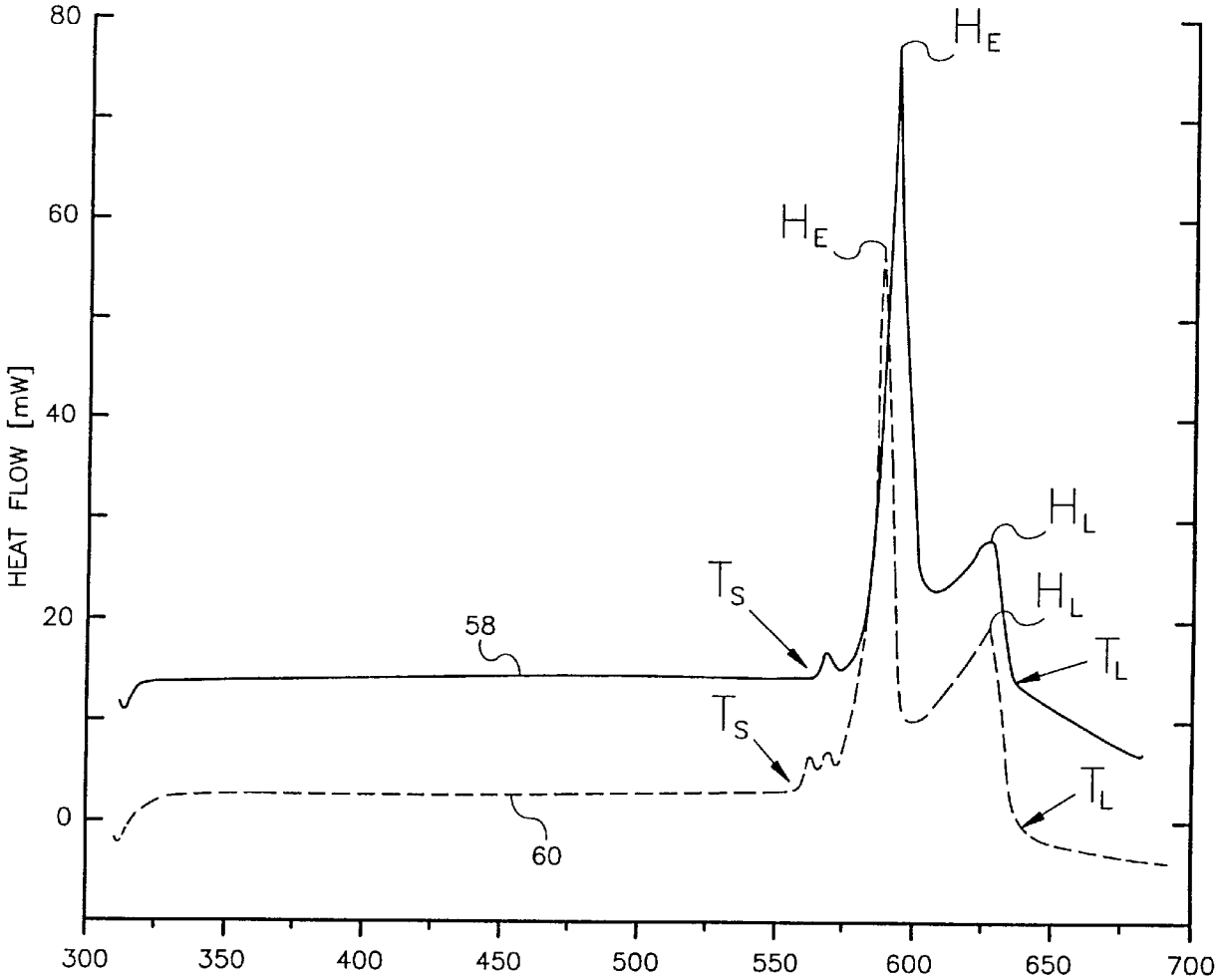
FIG. 9 is a DSC curve for aluminum base A356 alloy in both heterogeneous and homogeneous forms.

FIG. 9 illustrates in its first trace 58, the DSC curve for A356 alloy wherein the particulate feedstock represented chips from a slow cooled ingot. Accordingly, the microstructure was moderately heterogeneous. From the trace 58, the solidus temperature $T_S$ is seen at about 570° C. immediately prior to a very sharp and large eutectic reaction, the peak of which is designated at $H_E$. A secondary melting peak occurs immediately after the eutectic reaction and the liquidus temperature is seen to be about 630° C. From this, the range of temperature ($\Delta T_{S-L}$) from solidus to liquidus is approximately 60° C. and that significantly more energy is required in the eutectic reaction than in the subsequent reaction. With the peak of the eutectic reaction being the main melting peak, the ratio $R_{E/L}$ of the peak of the eutectic reaction ($H_E$) to the peak of the secondary melting reaction ($H_L$) is 4.2. The temperature range ($\Delta T_{20\%}$), is seen to be only about 19° C.

The second trace 60, seen in FIG. 9, is representative of the A356 alloy after complete melting of the alloy and slow cooling to form a near equilibrium homogeneous structure. The basic structure of the trace 60 is the same as that for trace 58, however, the solidus temperature ($T_S$) is shifted lower to about 560° C. The liquidus temperature ($T_L$) remains at about 630° C. and therefore the change of temperature ($\Delta T_{S-L}$), from solidus to liquidus, is about 70° C.

As with prior trace 58, the eutectic reaction is greater than the subsequent reaction and the ratio ($R_{E/L}$) of the peak of the eutectic reaction ($H_E$) to the peak of the secondary melting reaction ($H_L$) is 3.4. The temperature range ($\Delta T_{20\%}$) is seen only at 17° C.

The next aluminum sample involved 520 alloy in which the particulate feedstock was fast cooled shot having undergone a secondary milling operation, whose microstructure is heterogeneous. The DSC curve for this particular feedstock is identified in FIG. 10 as trace 62. No significant peak is seen in the first trace 62 to enable establishment of solidus temperature ($T_S$) from the trace 62. However, based upon the second trace 64 and the peak ($H_E$) of its eutectic reaction beginning after a solidus temperature of around 447° C., it is presumed that the solidus temperature for the alloy of the initial trace 62 is below that range. The liquidus temperature, as evidenced from the first trace 62, is approximately 625° C. and, from this a temperature range ($\Delta T_{S-L}$) from solidus to liquidus is calculated at greater than about 178° C. Lacking a defined peak for the eutectic reaction, the ratio of the peak of the eutectic reaction to the peak of the main melting reaction is negligible or about 0. The temperature range ($\Delta T_{20\%}$) is about 68° C.

Figure 10:
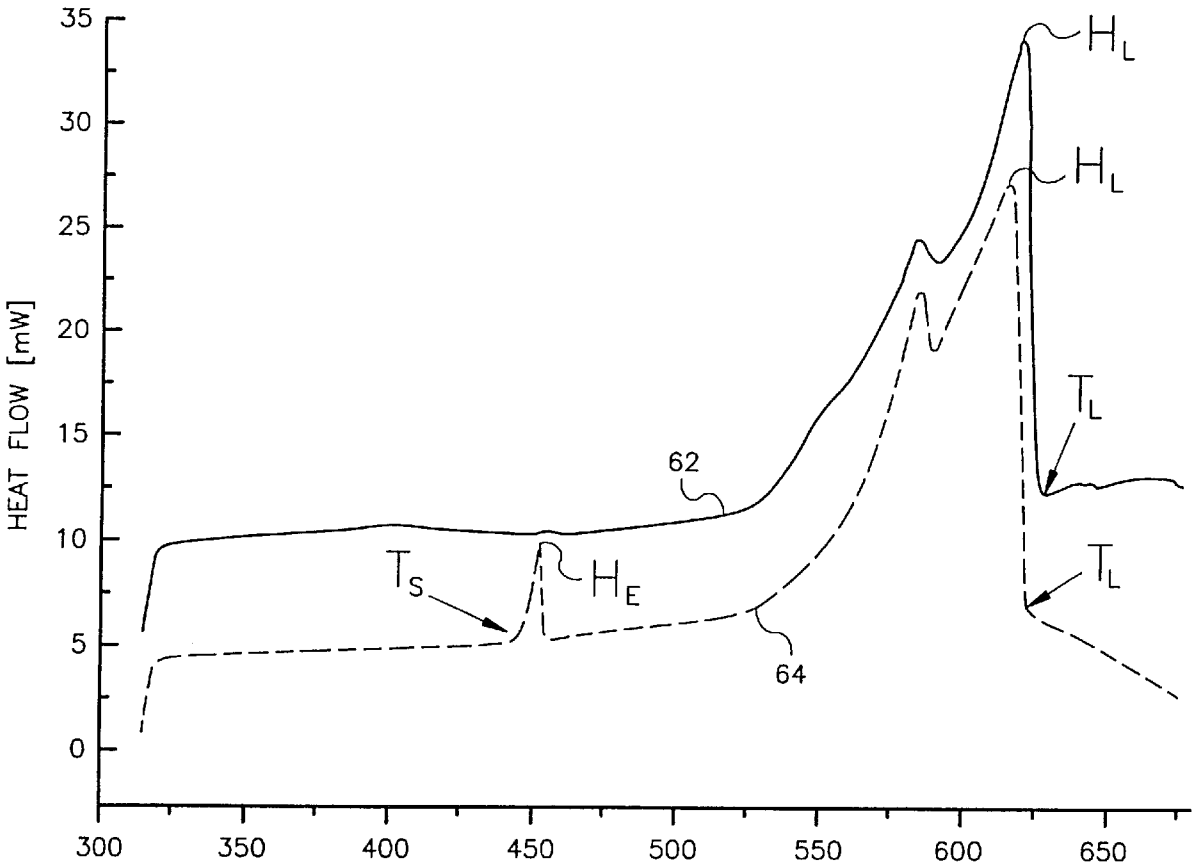
FIG. 10 is a DSC curve for aluminum base 520 alloy in both heterogeneous and homogeneous forms.

Heating the initial 520 alloy to complete melting and then subjecting it to slow cooling to form a near equilibrium homogeneous microstructure and subsequently developing a DSC curve for this material, resulted in the second trace 64 seen in FIG. 10. As mentioned above, a sharp eutectic peak is seen around 450° C. with the solidus temperature being approximately 447° C. The liquidus temperature is at about 625° C. Accordingly, the temperature range from solidus to liquidus ($\Delta T_{S-L}$) is 178° C. From this trace 64, the ratio of the peak of the eutectic reaction to the peak of the main melting reaction is about 0.23. The temperature range ($\Delta T_{20\%}$) is at 67° C.

Data from each of the above illustrated examples is presented below in Table 2. Additionally, the inventors' categorizing of the controllability of each alloy is also presented in the table.

TABLE 2

| Alloy | Form | $T_S$ (° C.) | $T_L$ (° C.) | $\Delta T_{S-L}$ (° C.) | $\Delta T_{20\%}$ (° C.) | $R_{E/L}$ | SSIM Control |
|---|---|---|---|---|---|---|---|
| AZ91D | Chipped Ingot | 433 | 602 | 169 | 55 | 0.3 | Good |
| | Remelt | 429 | 610 | 181 | 66 | 0.8 | |
| AZ91D | Chipped die cast scrap | <431 | 609 | >178 | 71 | 0.2 | Good |
| | Remelt | 430 | 612 | 182 | 66 | 0.5 | |
| AZ91D | Chipped SSIM scrap | <439 | 601 | >162 | 66 | 0.01 | Very Good |
| | Remelt | 425 | 607 | 182 | 66 | 0.8 | |
| AM50 | Chipped Ingot | 520 | 631 | 111 | 34 | 0 | Medium |
| | Remelt | 507 | 632 | 125 | 32 | 0.05 | |
| AE42 | Chipped Ingot | 500 | 633 | 133 | 20 | 0 | Poor |
| | Remelt | 508 | 638 | 130 | 25 | 0.07 | |
| ZK60 | Chipped Ingot | <475 | 640 | >163 | 49 | 0 | Medium/Good |
| | Remelt | 475 | 640 | 163 | 40 | 0.2 | |
| ZAC | Chipped Ingot | 337 | 601 | 264 | 59 | 0.14 | Medium/Good |
| | Remelt | 340 | 603 | 263 | 63 | 0.13 | |
| A356 | Chipped Ingot | 570 | 630 | 60 | 19 | 4.2 | Very Poor |
| | Remelt | 560 | 630 | 70 | 17 | 3.4 | |
| 520 | Milled Shot | <447 | 625 | >178 | 68 | 0 | Very Good |
| | Remelt | 447 | 625 | 178 | 67 | 0.23 | |

Based upon the above table and the SSMI control results, it is seen that in order to reduce thermal shock on the barrel 17 upon the introduction of the feedstock therein and to further minimize thermal shock and fatigue in subsequent zones in the barrel 17, it is desirable to provide a feedstock having a larger temperature range from solidus to liquidus ($\Delta T_{S-L}$), as opposed to a narrower range. Additionally for the same reason and for the reason of preventing plugging, a relatively large temperature range ($\Delta T_{20\%}$) is desired. Of the illustrated examples, AM50 alloy, AE42 alloy and A356 alloy all had solidus to liquidus temperature ranges ($\Delta T_{S-L}$) of less than 140° C., $\Delta T_{20\%}$ temperature ranges of less than 40° C. and showed SSMI controllability which was less than that of the other samples. From this a desirable magnesium and aluminum feedstock is seen to have the following characteristics: $\Delta T_{S-L}$ of a greater than 140° C. and more preferably greater than 160° C.; $R_{E/L}$ of less than 0.5 and more preferably less than 0.3; and a temperature range $\Delta T_{20\%}$ being greater than 40° C. and more preferably greater than 55° C. The resultant feedstock decreases thermal shock to the barrel 17 while spreading melting over a plurality of zones in the barrel and also decreasing the likelihood of plugging. Further, a more heterogeneously structured feedstock (as achieved through fast cooling) has been found to generally lead to higher $\Delta T_{S-L}$, lower $R_{E/L}$, and higher $\Delta T_{20\%}$, all of which cooperate to provide for good controllability of SSMI molding.

FIG. 11 illustrates the inventive concept of the DSC curve of the alloy following the heat curve for the barrel itself. By doing so, less thermal shock (outside the barrel temperature versus inside barrel temperature) and plugging is experienced by barrel 17. The larger difference between the required outside barrel temperature and the resulting feedstock temperature, the greater the thermal shock to the machine. In FIG. 11, the required temperature for the barrel (measured on the exterior of the barrel) and the temperature of the inside of the barrel are presented for two different feedstocks, both relative to the various zones of the barrel 17. The illustrated alloys are AE42 (designated at 74) and AZ91 (SSMI scrap) (designated at 76). DSC curves for the AE42 alloy and the AZ91 (SSMI scrap), relative to the heating zones, are also presented therein. From the figure, it is seen that the AZ91 (SSMI scrap) DSC curve more closely follows the required barrel temperature, thus requiring lower barrel temperatures and causing less thermal shock. From the figure, it is seen that less energy is required when the eutectic reaction is moderated by being spread out and this is further seen as being a result of heterogeneity. The curves for the AZ91 alloy are designated as 66 (outside barrel temperature) and 68 (inside barrel control temperature) while for AE42 they are designated at 70 (outside barrel temperature) and 72 (inside barrel control temperature). It is seen that higher control/outside barrel temperatures are needed for AE42, compared to AZ91D.

In the samples not shown in FIG. 11, the heterogeneous form of the alloy exhibited better contributions of $\Delta T_{20\%}$ and $R_{E/L}$ than for the more homogeneous form of the alloy. The larger the temperature range ($\Delta T_{20\%}$) the less the thermal shock in the various heating zones of the barrel 17 and the greater the control over fraction solids in the final molded part. The shorter this range $\Delta T_{20\%}$, the more significant any change in temperature of the semi-solid slurry will be upon the percent fraction solids of the final molded part. Of the illustrated examples, only the heterogeneous AZ91D alloys, ZAC alloy and A520 have temperature ranges for twenty percent melting energy ($\Delta T_{20\%}$) of greater than 55° C. and $R_{E/L}$'s of less than 0.3. By spreading out this reaction, upon the in feed of additional feedstock the ability of an already melted alloy constituent to refreeze within the barrel around the screw and therefore block and plug the machine 10 is diminished. In all of the illustrated examples, the near equilibrium homogeneous microstructure forms of the material exhibited sharper and more vigorous eutectic reaction. A preferred characteristic of the particulate feedstock alloy is one with a broadened eutectic reaction, again allowing for reduced thermal gradients in the initial portions of the barrel.

These characteristics are seen to be general behavior applicable to magnesium and aluminum, and therefore to zinc, copper and other alloy bases as well. For Zn alloys at ($\Delta T_{S-L}$) of more than 100° C. would be acceptable.

The nominal compositions of the illustrative alloys are presented below in Table 3.

TABLE 3

Alloys Normal Composition (Traces not included)

| Mg Base (Mg Balance) | | | Other | | | |
|---|---|---|---|---|---|---|
| Alloy | Al | Zn | Rare Earth | Ca | Zr | Si |
| AZ91D | 9 | 0.7 | — | — | — | — |
| AM50 | 5 | — | — | — | — | — |
| AE42 | 4 | — | 2–3 | — | — | — |
| ZAC | 5 | 8 | — | 0.6 | — | — |
| ZK60 | — | 6 | — | — | 0.6 | — |
| AS41 | 4 | — | | — | — | 1 |

In addition to the above, Al alloys with improved moldability over A356 and designed with improved $\Delta T_{20\%}$, $H_{E/L}$, and $\Delta T_{S-L}$ are in the range: Al base, 2.6 to 5.0 Si, 1.5 to 3.0 Cu, 2 to 4 Mg, 0.5 to 3 Zn.

Zn alloys with improved moldability over Zamac 3 and with the improved characteristics mentioned above are in the range: Zn base, 25 to 50, Al, 0.5 to 6.0 Cu. Moldable Cu alloys with the improved characteristics are in the range: Cu base, 25 to 30 Zn, 0 to 6 Ni, 3 to 7 P.

Magnesium base alloys with the improved characteristics are in the range: Mg base, 4–6 Al, 1–2.5 Si.

Also, AZ91D formed as shot, especially thixotropic shot, and rechipped AZ91D SSMIM scrap are preferred over chipped ingot AZ91D. Such treatments will also benefit alloys 520, ZAC, ZK60 and, to a lesser extent, AM50 and AE42.

As discussed above, various benefits are obtained by the particulate feedstock having a non-equilibrium or heterogeneous structure. This structure can either be the microstructure, as seen above, or the macrostructure of the feedstock and results in the spreading out of the eutectic reaction.

To form the heterogeneous structure in the microstructure of the feedstock, fast cooling of the alloy to be subsequently formed into the feedstock provides segregation of the alloy elements in the particles thereby broadening the eutectic melting range and lowering the start temperature. Fast cooling of the initial melt can be achieved by several methods. Relatively slow cooled ingots which are subsequently mechanically chipped and at the particulate feedstock have a moderate heterogeneous structure. As a result, they exhibit relatively large spikes during the eutectic reaction. This is most readily seen in comparing the other AZ91 alloys prepared from thin sections of die casting scrap and semi-solid injection molding scrap AZ91 alloy from ingots. In the former two cases, cooling occurs very rapidly resulting in the heterogeneous nature of the microstructure. Cooling rates are generally 20 to 40° C./S as compared to 3° C./S for ingot stock. Similarly, chips could also be formed from mold cast sheets.

Another method by which fast cooled particulate feedstock could be formed with a heterogeneous microstructure is by way of one of the known shot production methods. Those methods include water spraying, spraying in air or protective atmosphere and dropping the melt stream onto a rotational plate, drum or wheel. In all three of those methods, drops of the melt are fast cooled resulting in particulate feedstock having the desired heterogeneous microstructure. Enhanced micro-heterogeneity can be developed in the $\alpha+\beta$ region of FIG. 12 and then shotting or extruding pellets which are fast cooled.

The heterogeneous nature of the particulate feedstock could also be on a macro structure level. In such feedstock, particulates of the low melting point constituent(s) are mixed with alloyed particulates of higher melting point constituents. The alloy particles containing the high melting point are initially formed such that they are lean in the low melting point constituent(s). As a result, the particulates of the low melting point constituent will first melt, increasing thermal transfer to the alloyed particulates and enhancing melting thereof. As the higher melting point particulates begin to melt, they will mix with the already melted low melting point constituent, combining and adjusting the overall alloy composition to the desired nominal composition. For example, ZAMAC 8 (Zn-8Al) alloy having a eutectic temperature of 381° C., can be added to aluminum ally 384, (nominally Al, 11.2 Si, 3 Zn, 3.8 Cu), with the eutectic temperature of 515° C. and which is lean in zinc thereby raising both $\Delta T_{20\%}$ and $\Delta T_{S-L}$ while lowering $R_{E/L}$, relative to the nominal alloy. Additional composition mixes achieving the above include: Al base with 2.6–5.0 Si, 1.5–3.0 Cu, 2–4 Mg and 0.5–3 Zn, with 520 alloy mixed therein; AE42 and ZAMAC 3 (Zn-3Al) yielding 2–5 Zn; AS41 and Zamac 3 yielding 1–5 Zn; AM50 and ZAMAC 3 yielding 2–5 Zn and Cu 25–30 Zn with Cu8.3P. The above resulting mixtures being seen to spread out the initial melting reaction.

From the above, it is seen that the inventors of the present invention have designed a new particulate feedstock particularly applicable for use in semi-solid injection molding processes. Particulate feedstock meeting this criteria have the following general characteristics: a heterogeneous structure, a temperature range $\Delta T_{S-L}$ from solidus to liquidus of at least 140° C. (80° C. for Zn base), $R_{E/L}$ of less than 0.3 and $\Delta T_{20\%}$ of greater than 55° C. An additional desired characteristic of the feedstock is a eutectic reaction utilizing no more than ten percent of the energy required for melting. The above reduces thermal gradients and shock, allows for more precise control of the fraction solids in the final part and plug formation in the nozzle at the end of each injection stroke, and also reduces operating temperature, operating energy consumption and the potential for plugging of the screw.

It is to be understood that the invention is not limited to the exact construction illustrated and described above, but that various changes and modification may be made without departing from the spirit and scope of the invention as defined in the following claims.

What is claimed is:

1. An alloy feedstock for semi-solid, metal, injection molding, said feedstock comprising:

a magnesium alloy material in particulate form, said alloy material having a heterogeneous structure, having a heat flow versus temperature curve with a heat flow temperature range of greater than 40° C. when measured at 20% of the height of the peak of the main melting reaction, and having a heat flow ratio of less than 0.5 for the height of the peak of the eutectic reaction relative to the height of the main melting reaction, wherein said alloy material having said heterogeneous structure has a lower eutectic temperature than said alloy material with a homogeneous structure such that said alloy material having said heterogeneous structure forms a portion of the liquid phase below said eutectic temperature of said homogeneous structure.

2. The alloy feedstock of claim 1 further comprising a melting range from solidus to liquidus of greater than 140° C.

3. The alloy feedstock of claim 1 wherein said heterogeneous structure is said feedstock's macrostructure.

4. The alloy feedstock of claim 1 wherein said heterogeneous structure is said feedstock's microstructure.

5. The alloy feedstock of claim 1 wherein said feedstock is shot.

6. The alloy feedstock of claim 5 wherein said shot is rapidly cooled shot.

7. The alloy feedstock of claim 6 wherein said rapidly cooled shot is cooled from a two-phase region.

8. The alloy feedstock of claim 1 wherein said material includes mixed granules, said mixed granules having at least two different solidus temperatures.

9. The alloy feedstock of claim 8 wherein said mixed granules are provided in a ratio such that they are capable of forming an alloy by a semi-solid metal injection molding process.

* * * * *